US006688350B2

(12) United States Patent
Heinlen et al.

(10) Patent No.: US 6,688,350 B2
(45) Date of Patent: Feb. 10, 2004

(54) POWER TOOL PLATFORM

(75) Inventors: Gerald Thomas Heinlen, Cedar Falls, IA (US); Robert John Mehmen, Shell Rock, IA (US); Troy Lynn Moller, Cedar Falls, IA (US)

(73) Assignee: Waterloo Industries, Inc., Waterloo, IA (US)

( * ) Notice: Subject to any disclaimer, the term of this patent is extended or adjusted under 35 U.S.C. 154(b) by 0 days.

(21) Appl. No.: 10/106,758

(22) Filed: Mar. 26, 2002

(65) Prior Publication Data

US 2003/0183303 A1 Oct. 2, 2003

(51) Int. Cl.[7] ..... B25H 1/12
(52) U.S. Cl. ..... 144/285; 144/286.5
(58) Field of Search ..... 144/285, 286.5, 144/286.1; 83/477, 477.2; 312/281, 237, 277

(56) References Cited

U.S. PATENT DOCUMENTS

| | | | | | |
|---|---|---|---|---|---|
| 3,771,848 | A | * | 11/1973 | Claywell | 312/237 |
| 4,291,869 | A | * | 9/1981 | Hickman | 229/125.17 |
| 4,408,642 | A | * | 10/1983 | Jeruzal et al. | 144/286.5 |
| 4,483,573 | A | * | 11/1984 | Keller | 312/281 |
| 4,733,703 | A | * | 3/1988 | Cimino | 144/285 |
| 4,874,025 | A | | 10/1989 | Cleveland | |
| 5,139,065 | A | | 8/1992 | Stark | |
| 5,239,934 | A | | 8/1993 | Miller | |
| 5,582,225 | A | * | 12/1996 | Schank | 144/286.1 |
| 5,722,473 | A | | 3/1998 | Tucker | |
| 6,047,750 | A | * | 4/2000 | Jensen | 144/286.1 |
| 6,209,597 | B1 | | 4/2001 | Calcote | |

FOREIGN PATENT DOCUMENTS

| | | | |
|---|---|---|---|
| EP | 0 913 230 A | | 5/1999 |
| FR | 0031414 A2 | * | 7/1981 |
| GB | 2244670 A | * | 12/1991 |

* cited by examiner

*Primary Examiner*—Allen Ostrager
*Assistant Examiner*—Shelley Self
(74) *Attorney, Agent, or Firm*—Banner & Witcoff, Ltd.

(57) ABSTRACT

A power tool workstation for mounting one of a series of different power tools includes a top plate with a flanged opening therein for receipt of an insert upon which any one of a number of power tools is mounted.

16 Claims, 5 Drawing Sheets

34
38
29
36
42
30
40
18
26
24

54
50,52
44
34
30
33
37
10
12
18
26
16
20
24
28

POWER TOOL PLATFORM

BACKGROUND OF THE INVENTION

In the principal aspect the present invention relates to a power tool workstation construction and, more particularly, to a modular tool work station capable of receiving and mounting any one of a series of distinct tools, most especially, power tools.

Woodworking shops as well as home hobbyists typically use a variety of woodworking tools such as routers, band saws, drill presses, planers, table saws, vices, and the like. Most often each of these separate tools are permanently mounted on their own support table or bench. The worker or craftsman will then move the various work pieces to the bench or station where the desired tool is located. Often however, there is restricted space for placement of work benches or stations and, typically, some equipment or power tools are needed only on certain, minimal occasions. Further, with respect to such tools it is desirable to insure minimum dust pollution while at the same time providing a sturdy support or bench for the work tool. Additionally, the cost of a separate workbench for each tool can be excessive. Finally, many workbenches for each of a number of separate tools may have a different height thus requiring the worker to adjust the height of the workbench or the tool in some manner as the worker moves from station to station. That is, worker comfort is facilitated by maintaining the separate tools at a generally constant height or work level. Further, it is often desirable to move the tools. Most workbenches are not easily movable. Also, with most workbenches it is difficult to replace or remove the tool for repair or service.

With the aforesaid needs and desires in mind, the present invention was developed.

SUMMARY OF THE INVENTION

Briefly, the present invention comprises a power tool workstation construction that is used for mounting any one of the series of distinct tools or power tools. The workstation includes a rectangular, parallelepiped, sheet metal cabinet or base having an open top with a special tool support plate fixed or attached to the open top. Wheels are provided along one side of the cabinet at the floor level so that the cabinet may be tilted and easily moved. The tool support plate, affixed to the open top of the cabinet, overlaps or extends beyond the edges of the cabinet or base to facilitate lifting, tilting and moving of the cabinet. The cabinet includes a front door for access to the contents and for access to a dustbin that is positioned beneath the open top and accessible to a dust exhaust discharge system. The tool support plate includes an opening or passageway with a flange for support of an insert panel or insert. A separate tool is mounted on each separate insert and the insert may then be positioned in the opening in a tool support plate of a bench or work station. Because the inserts for the support plate are equally sized, any one of a number of separate tools may be supported and used in combination with the workstation. The insert rests on the flange in the opening and a fastening mechanism retains the insert and the tool attached thereto on the support plate. With this construction any one of a number of tools may be mounted, each on a separate insert, and each maintained in a storage cabinet to be available for placement on the support plate. Because the inserts for the support plate are equally sized, any one of a number of separate power tools may be supported and used in combination with the workstation. The insert may, itself, include a removable insert plate for mounting, by way of example, a router wherein the router blade would project upwardly through the insert plate with the router itself positioned within the interior of the cabinet. Optional table top extensions which include a horizontal support bracket and a vertical support leg may be attached to the main workstation cabinet to provide an additional work surface on either side of the workstation. Typically the corners of the support plate of the workstation are radiased or chamfered for purposes of safety. Differently shaped and sized work plates may be attached to the top of the cabinet. For example, a corner cabinet construction with an angled sided support plate may be provided.

Thus it is an object of the invention to provide an improved power tool support cabinet construction.

It is a further object of the invention to provide a power tool support construction which is capable of supporting any one of a number of distinct power tools.

Another object of the invention is to provide an economical, rugged, easily assembled, easily transported workstation for power tools, which is stable, yet capable of movement.

These and other objects, advantages, and features of the invention will be set forth in the detailed description which follows.

BRIEF DESCRIPTION OF THE DRAWING

In the detailed description, which follows reference, will be made to the drawing comprised of the following figures.

DESCRIPTION OF THE PREFERRED EMBODIMENT

Figure 1:
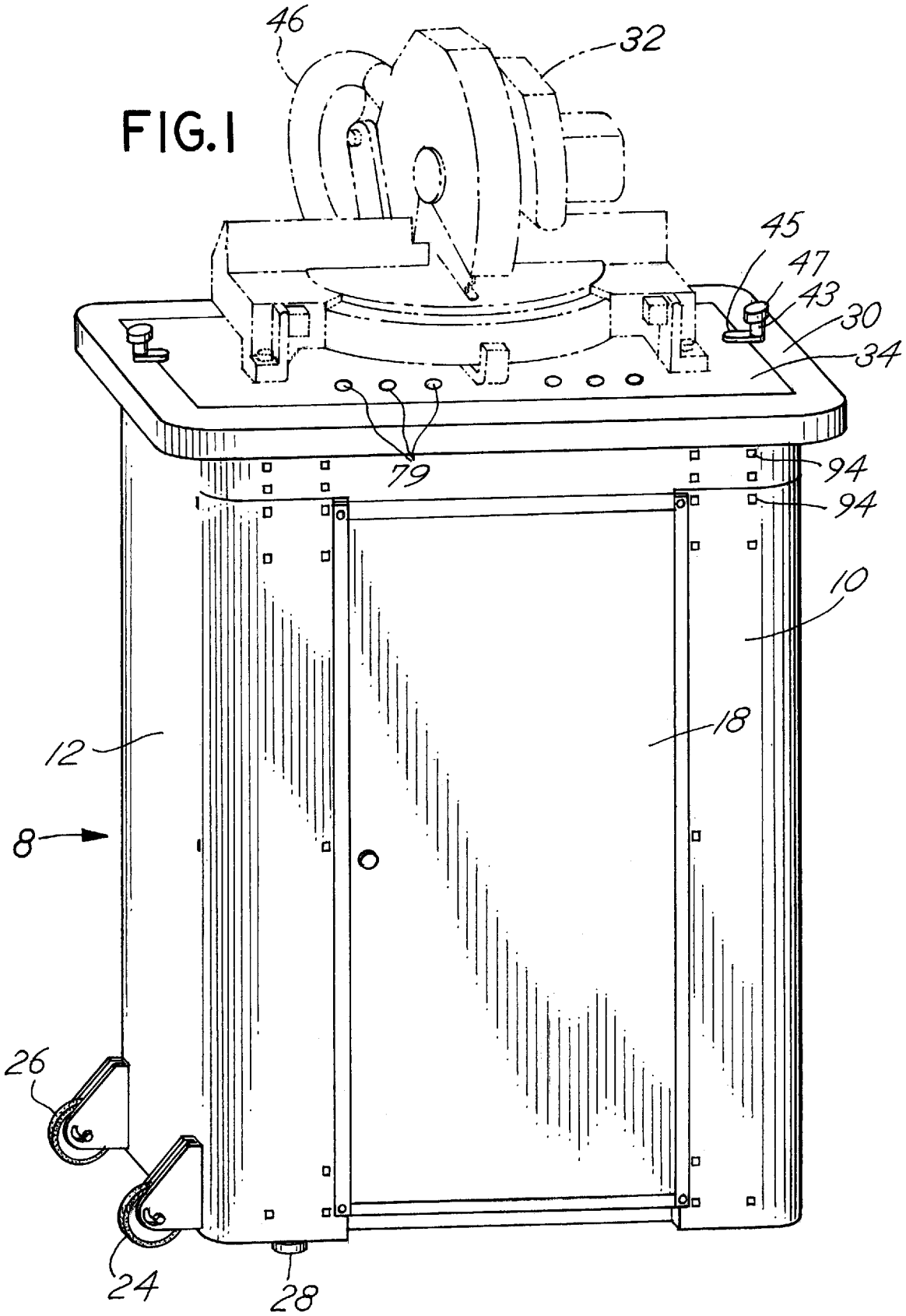
FIG. 1 is an isometric view of the improved workstation of the present invention in combination with a power tool.
Figure 2:
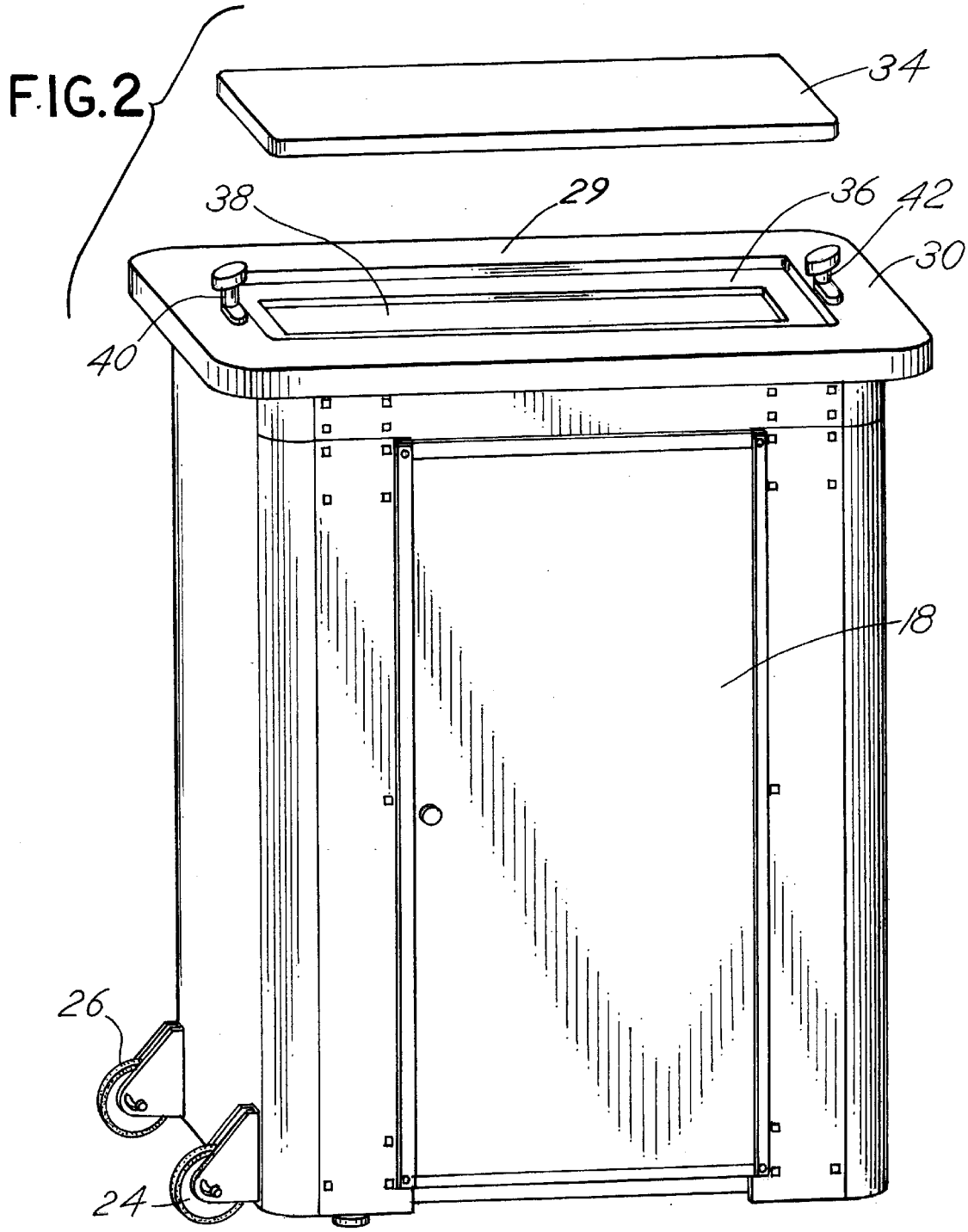
FIG. 2 is an exploded isometric view of the workstation of FIG. 1.

The workstation of the invention is comprised of a rectangular, parallelepiped sheet metal cabinet 8 which includes a front side or panel 10, a first lateral side panel 12, a second lateral side panel 14, and a back panel 16. The panels 10, 12, 14, and 16 define a rectangular parallelepiped cabinet with an open front to which a hinged door 18 is preferably attached. A bottom panel 20 reinforces the connected side panels 10, 12, 14, 16. The first lateral side panel 12 includes first and second wheels 24 and 26 attached thereto. Affixed to the bottom panel 20 on each of the bottom corners of the cabinet is an adjustable foot, for example foot 28, which may be used to adjust the height of the cabinet.

Figure 3:
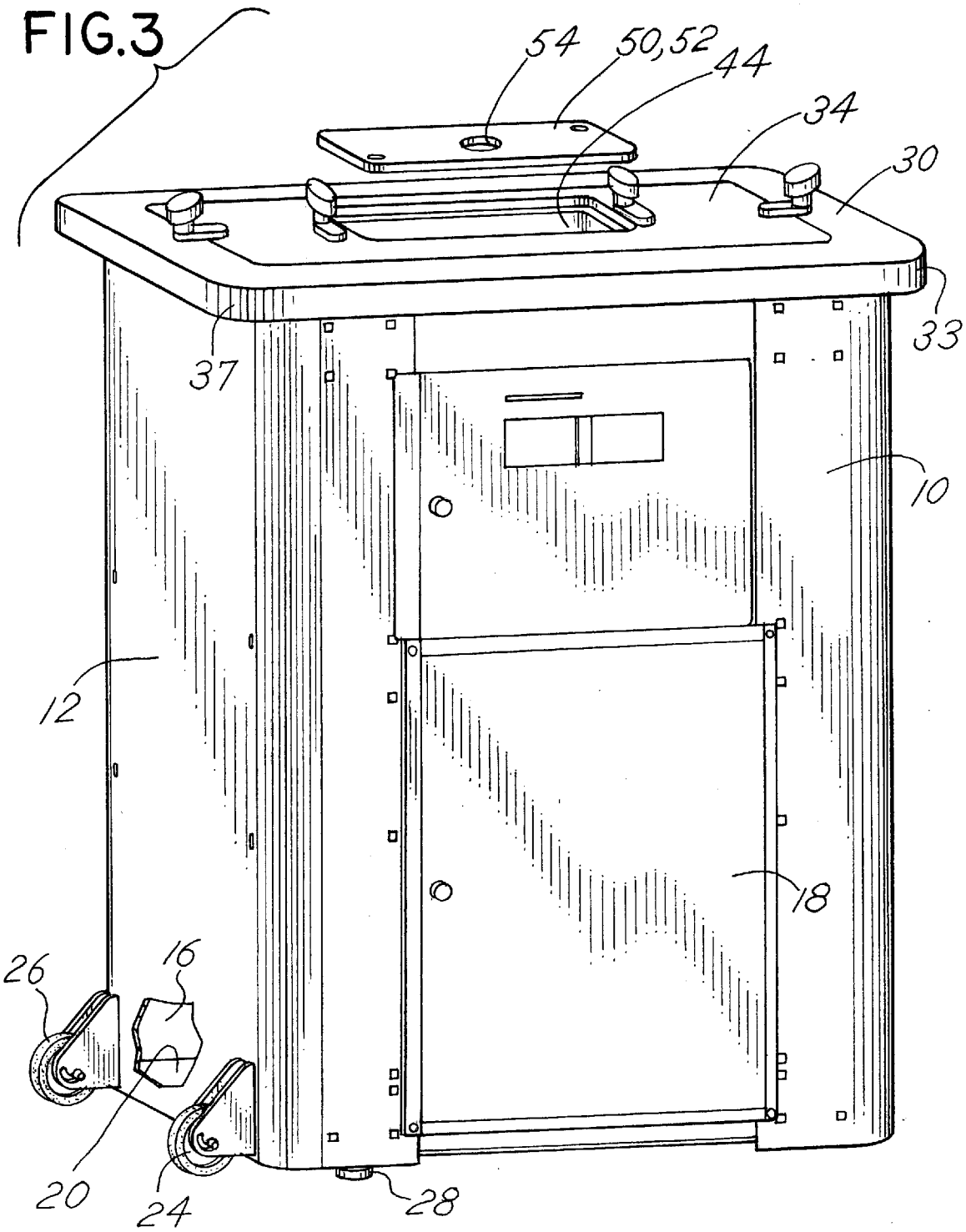
FIG. 3 is an isometric view of a workstation having a support plate constructed for use with a router.

The top of the cabinet 8 is open and is four sided with a generally rectangular profile. Attached to the open top of the cabinet is a tool support plate 30. The support plate 30 is typically a wood or composite material rather then a metal material inasmuch as the plate 30 may be drilled with holes for attachment for a power tool such as the circular saw 32 in FIG. 1. Preferably, the plate 30 has a generally rectangular shape or profile as illustrated in FIGS. 1 and 3, for example, and is preferably in the range of ½ to 1 inch thick.

In the preferred embodiment, the plate 30 includes a rectangular or four-sided insert 34 on which a tool 32 is mounted. The insert 34 rests on a flange 36 defined in and extending around the periphery of a congruent opening 38 in the plate 30. The opening 38 typically is four sided or rectangular in shape and the flange 36 extends inwardly about the periphery of the opening and is likewise four sided or rectangular to thereby support the congruent insert 34. Manually actuated fasteners 40 and 42 are provided to retain the insert 34 in place in the opening 38 on the flange 36. The insert 34 has a thickness, which renders the top of the insert 34 coplanar with the top surface 29 of plate 30 when placed in the opening 38. This is the preferred embodiment of the invention.

The insert 34, as well as the plate 30, are typically fabricated from wood, or composite material which may be drilled or otherwise worked in order to facilitate attachment of a power tool and in order to provide openings therethrough for passage of dust to a bin 44 within the interior of the cabinet. The bin 44 is attached by means of a flexible hose 46 to a dust recovery system of the type typically found in wood shops and the like.

The insert 34 may itself include a further auxiliary panel insert 50 for support of a tool such as a router thereon, or alternatively the plate 30 may include a special panel insert 52 with a centered opening 54 therethrough. A router (not shown) could then be mounted on the underside of the panel insert 52 with a router blade extending through the opening 54 for exposure to work a work piece passing over the surface of the plate 30 and panel insert 52.

Figure 6:
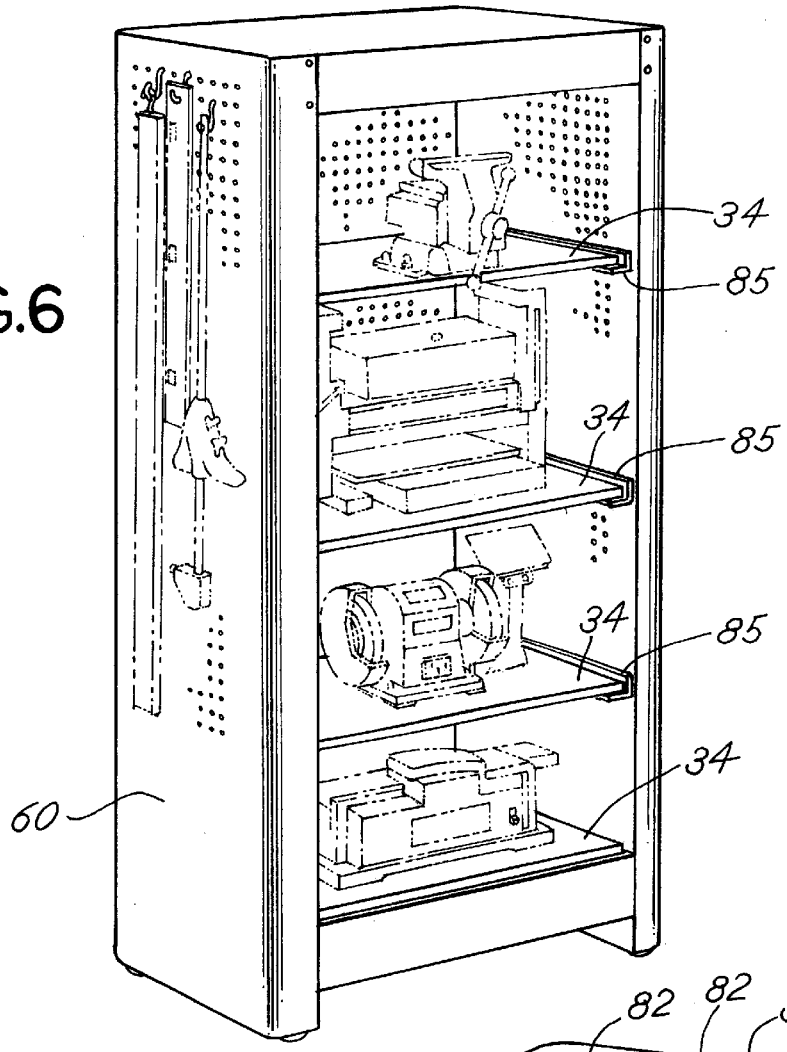
FIG. 6 is an isometric view of a storage cabinet for use in combination with the work station of the present invention wherein the storage cabinet is constructed to receive and support multiple power tools and other tools mounted on separate support plate inserts.
Figure 7:
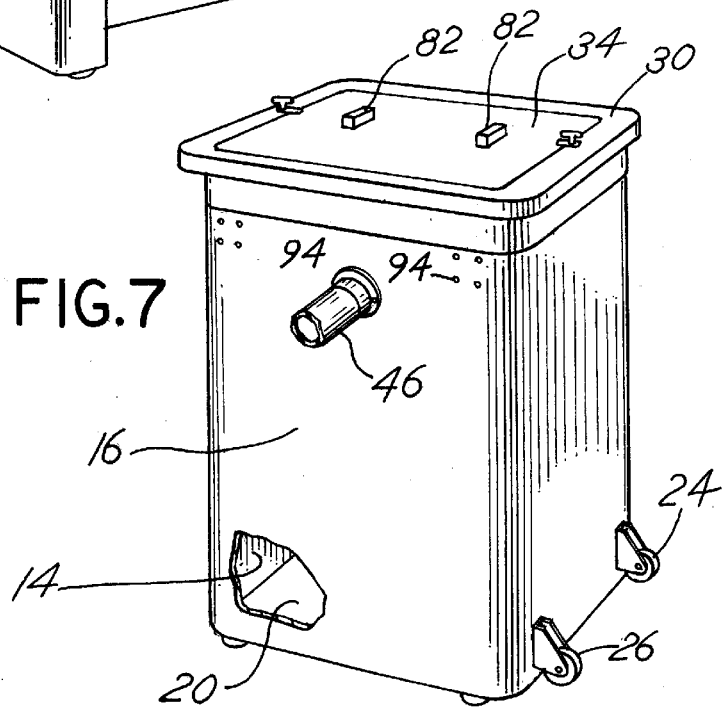
FIG. 7 is an isometric view illustrating the backside of the workstation of FIG. 1.

As depicted in FIG. 6 a number of separate power tools and other tools such as a vice, drill press, etc. may each be mounted on a separate insert 34 and stored on separate shelves of a cabinet 60. The cabinet 60 is typically an open sided cabinet with multiple spaced horizontal shelves 34 comprised of separate plates or inserts 34. Access to the tools stored in the cabinet 60 is thus rendered easy and the tool desired for use in combination with a workstation may be easily removed for placement in the congruent opening 38 of plate 30. Sawdust or other material resulting from a power tool operation can then be collected in the bin 44, for example, and directed through a tube 46 to the work shop exhaust system and dust collection system.

Preferably the plate 30 extends beyond the edges of the cabinet 8 defined by the panels 10, 12, 14, and 16. This provides a handhold for tilting of the cabinet 8 when movement of the cabinet 8 is desired. Additionally, this provides for protection of the worker that is using the tool and also provides improved access around the sides of the cabinet 8. Further, since the corners 33, 37 of the plate 30 are radiused or chamfered, a worker will not be exposed to a sharp corner when moving about the circumference of the workstation as the tool at the station is being used.

Figure 5:
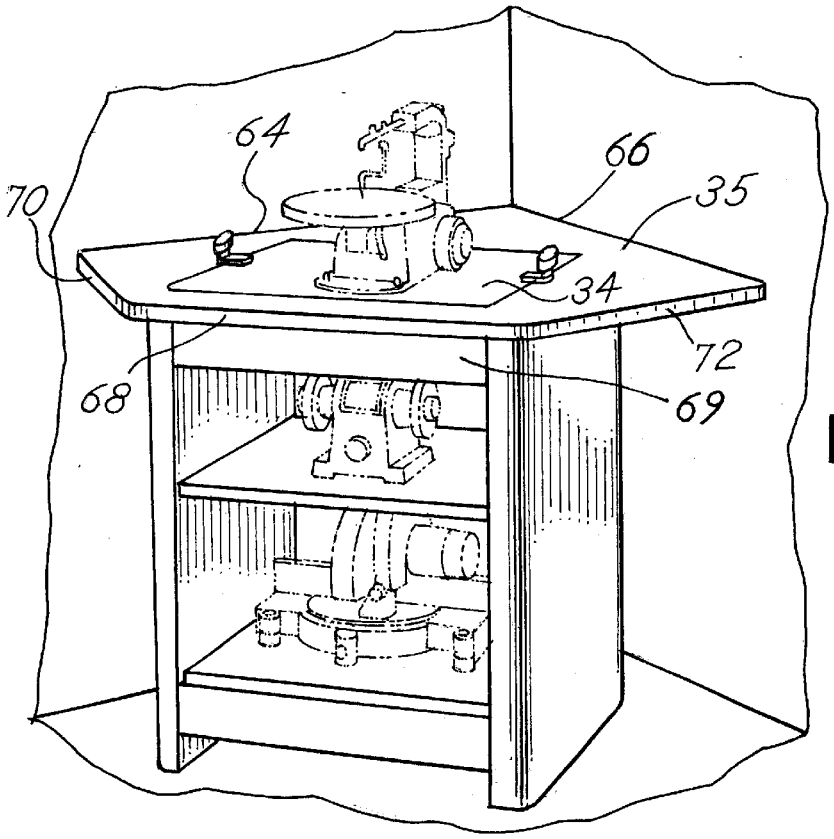
FIG. 5 is an isometric view of a workstation having an alternative style support plate mounted thereon for use in a corner.

The shape of the plate 30 may be varied in other respects to accommodate needs of the workstation operator and the tool room in which the work stations are situated. For example, as shown in FIG. 5, a specially configured plate 35 is designed to permit placement of a workstation cabinet in a corner. Thus the plate 35 includes five sides with the backsides 64 and 66 at right angles for placement in a corner. The front side 68 is parallel to the cabinet front panel 69 and the lateral sides 70 and 72 of plate 35 define an angle so that an adjacent rectangular work station plate 30 will fit against the side 70 or 72.

Latch 42 typically comprises a rotatable stem 43 mounted in plate 30 with a projecting lug 45 for holding insert 34 in place upon rotation by griping handle 47.

Further features of the modular cabinets include a plate 30 or insen 34 which includes a pattern of passages or openings 79 to facilitate collection of sawdust, grit and shavings in a dust collection bin on the inside of the cabinet 8 from a sander, for example, or a drill. Additionally, the openings 79 may receive dogs or stops that maintain a work piece. Thus, an insert 34 may include a pattern of openings or recesses 79 for mounting work piece dogs or stops 82 which are adjustable.

The tool storage cabinet 60 may or may not include access doors. Storage cabinet 60 may include adjustable opposed support flange members 85 in FIG. 6 for support of inserts 34 with a tool mounted thereon. The tool storage cabinet 60 and a plurality of cabinets 8 in combination with inserts 34 may be arrayed in a workroom in a desired and efficient array which is adjustable inasmuch as the cabinets 8 are mounted on wheels 24, 26 and the inserts 34 with assorted tools may all be moved easily.

Figure 4:
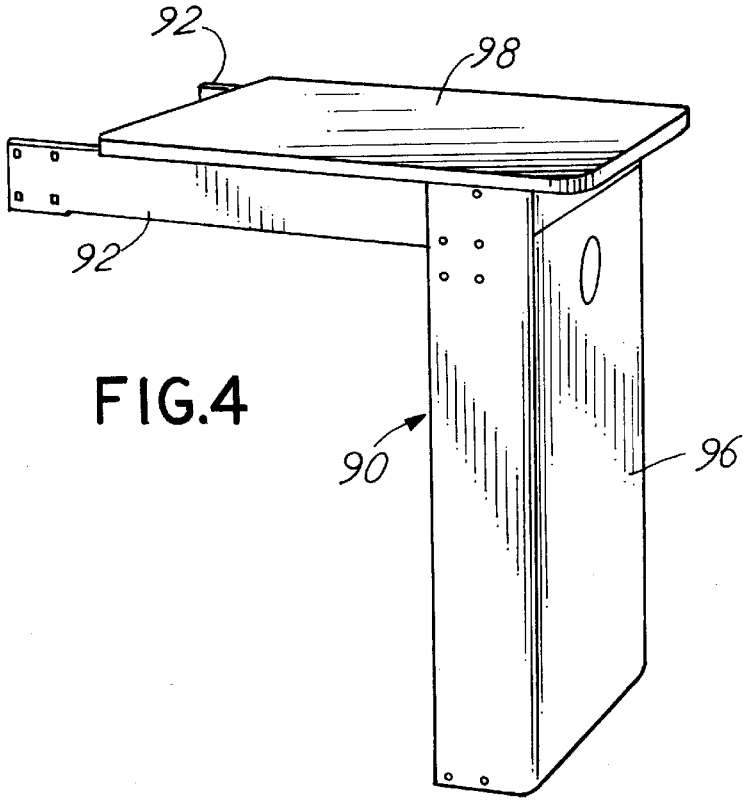
FIG. 4 is an isometric view of a supplemental support platform extender or extension for use in combination with a workstation of the type shown in FIG. 1.

As depicted in FIG. 4, a supplemental work support stand 90 may be attached to a cabinet 8 by bolting support arms 92 to the top bolt openings 94 of cabinet 8. The stand 90 thus includes a vertical leg 96, horizontal arms 92 and a top work platform 98.

Various modifications of the construction may be implemented. That is, the height of the sheet metal cabinet may be varied. The arrangement and position of doors and shelves may be varied. The particular plate fastener such as fasteners 40 and 42 may be varied. Thus the invention is to be limited only by the following claims and equivalents thereof.

What is claimed is:

1. A modular tool workstation for mounting any one of a series of distinct tools, said work station comprising, in combination:

a rectangular, parallelpiped, sheet metal cabinet having an open top, an open front and a first lateral side with a bottom edge, said open top having a first, four-sided profile;

a tool support plate attached to and covering the open top, said tool support plate including a generally four-sided opening to the interior of the cabinet with a flange in and extending about the periphery of the four sided opening;

said flange recessed in the opening of the plate and extending inwardly from the periphery of said four sided opening;

a tool support insert having a shape congruent with the opening of the plate and supported on the flange of the plate in the opening coplanar with the top surface 29 of the plate;

first and second retention latch members on the tool support plate on opposite lateral sides of the opening, said latch members moveable between an insert retention position and an insert release position for holding the insert in position in the opening when in the retention position; and a tool mounted on the insert.

2. The workstation of claim 1 wherein the cabinet includes a base and further includes an adjustable length foot in each corner of the cabinet at the base thereof.

3. The workstation of claim 1 including a port in the cabinet for access to the interior of the cabinet and a dust collection bin positioned beneath the opening in the plate.

4. The workstation of claim 1 wherein the top support plate extends outwardly from the cabinet to provide a hand hold for engaging and tilting the cabinet onto the wheels for transport.

5. The work station of claim 1 in combination with an extension station, said extension station including a horizontal support bracket, a vertical leg extending downwardly from the horizontal support bracket, and a top plate mounted on the horizontal bracket, said bracket extending from the top plate for attachment to the cabinet, said vertical leg supporting the top plate level with the top support plate of the cabinet.

6. The work station of claim 1 wherein the insert includes an opening for a power tool to project into.

7. The work station of claim 1 wherein the corners of the support plate are radiused or chamfered.

8. The work station of claim 1 in combination with a plurality of equally sized inserts, each insert including a different power tool mounted thereon.

9. The work station of claim 8 in combination with a multiple shelf storage cabinet for storage of a multiple member of inserts having different tools mounted on each insert.

10. The work station of claim 1 wherein the first four sided profile is rectangular.

11. The work station of claim 1 wherein the insert opening is rectangular.

12. The work station of claim 1 including an access door on the front of the cabinet.

13. The work station of claim 1 including wheels affixed to one side of the cabinet and a hand hold mechanism on the opposite side to permit tilting of the cabinet for movement on the wheels.

14. The work station of claim 1 wherein the plate includes a pair of intersecting sides on the back of the cabinet for placement of the cabinet in a corner with the front of the cabinet forming an acute angle with the pair of sides and wherein the plate further includes a front edge parallel to the front side of the cabinet.

15. The work station of claim 1 wherein the plate projects over the first profile and the sides of the cabinet.

16. The work station of claim 15 wherein the insert opening is rectangular and the sides of the cabinet define a rectangular parallelepiped.

* * * * *